United States Patent [19]

Harbulak et al.

[11] Patent Number: 4,483,711

[45] Date of Patent: Nov. 20, 1984

[54] AQUEOUS ELECTROLESS NICKEL PLATING BATH AND PROCESS

[75] Inventors: Edward P. Harbulak, Allen Park; Cynthia A. Stants nee Halliday, Lincoln Park, both of Mich.

[73] Assignee: OMI International Corporation, Warren, Mich.

[21] Appl. No.: 583,759

[22] Filed: Mar. 5, 1984

Related U.S. Application Data

[63] Continuation-in-part of Ser. No. 503,881, Jun. 17, 1983, abandoned.

[51] Int. Cl.[3] ..... C23C 3/02

[52] U.S. Cl. ..... 106/1.22; 106/1.25; 427/438; 427/443.1

[58] Field of Search ..... 106/1.22, 1.25; 427/438, 443.1

[56] References Cited

U.S. PATENT DOCUMENTS

| | | | |
|---|---|---|---|
| 2,762,723 | 9/1956 | Talmey et al. | 427/438 |
| 2,822,293 | 2/1958 | Gutzeit et al. | 427/438 |
| 2,937,978 | 5/1960 | Strauss et al. | 204/49 |
| 3,489,576 | 1/1970 | Vincent et al. | 106/1.22 |

*Primary Examiner*—Lorenzo B. Hayes

*Attorney, Agent, or Firm*—Richard P. Mueller

[57] ABSTRACT

An improved aqueous electroless nickel plating bath and process for chemically depositing nickel on a substrate comprising an aqueous solution containing nickel ions, hypophosphite ions, a complexing agent, preferably a buffering agent and a wetting agent, and a small but effective amount of a sulfonium betaine compound sufficient to control the rate of nickel deposition and the concentration of phosphorus in the nickel deposit, preferably, in further combination with supplemental organic and/or inorganic rate stabilizers. The invention further contemplates a process for rejuvenating an electroless nickel bath which has been rendered inoperative due to the presence of excessive concentrations of supplemental stabilizing agents by the addition of a controlled effective amount of a sulfonium betaine compound sufficient to restore the bath to an operative plating condition.

20 Claims, No Drawings

AQUEOUS ELECTROLESS NICKEL PLATING BATH AND PROCESS

REFERENCE TO RELATED APPLICATIONS

The present application is a continuation-in-part of prior copending application Ser. No. 503,881 filed June 17, 1983 now abandoned.

BACKGROUND OF THE INVENTION

The present invention broadly relates to the autocatalytic chemical deposition of nickel, and more particularly, to an improved aqueous electroless nickel plating bath and process for depositing nickel on a substrate.

A variety of nickel containing aqueous solutions have heretofore been used or proposed for use for chemically depositing nickel on a substrate incorporating various additive components for controlling the rate of nickel deposition and for promoting stability of the bath after prolonged usage. Among such compositions are those such as disclosed in U.S. Pat. Nos. 2,762,723; 2,822,293; and 3,489,576. In addition to a controlled concentration of nickel ions, such prior art electroless nickel plating baths conventionally employ hypophosphite anions for reducing the nickel cation to the metallic state and the hypophosphite anions are in turn oxidized to phosphite anions and other degradation products some of which combine with other nickel ions present in the solution forming a finely particulated dispersion producing a random chemical reduction of the other nickel ions present in the bath causing the resultant nickel deposit on the substrate to become progressively coarse, rough and sometimes porous. The presence of such fine-sized dispersed particulate matter also promotes instability of the chemical balance of the bath ultimately resulting in a decomposition thereof necessitating discarding the bath and replacement.

For these and other reasons, various additive agents as described in the aforementioned U.S. patents have heretofore been employed or proposed for use to stabilize the bath and to further control the rate of nickel deposition on a substrate being plated. In such electroless nickel plating baths employing hypophosphite ions as the reducing agent, the nickel deposit actually comprises an alloy of nickel and phosphorus with the phosphorus content usually ranging from about 2 to about 15 percent by weight. The physical and chemical properties of such nickel-phosphorus alloy deposits are related to the percentage of the phosphorus present and in turn, the percentage of phosphorus in the deposit is influenced by a number of factors including the bath operating temperature, the operating pH, the hypophosphite ion concentration, the nickel ion concentration, the phosphite ion and hypophosphite degradation product concentration as well as the total chemical composition of the bath including additive agents.

In end uses of electroless nickel plated articles, those applications requiring maximum deposit hardness or nickel deposits which are nonmagnetic, it is normally necessary to provide nickel alloy deposits with a relatively high percentage of phosphorus such as 9 percent by weight or greater. However, there are numerous other applications for electroless nickel-phosphorus alloys in which a lower percentage of phosphorus is desirable and an Aerospace Material Specification, AMS2405A provides for nickel-phosphorus alloy deposits in which the phosphorus content is to be held to a minimum and, in any event, shall not exceed 8 percent by weight.

Prior art compositions and processes for producing nickel-phosphorus alloy deposits having low percentages of phosphorus have been found susceptible to producing bath instability, a shortening of the operating life of the bath and/or have caused increased difficulty to control the bath because of the relatively narrow concentration ranges of some of the bath constituents. For example, the addition of thiourea to an electroless nickel bath has been found effective to reduce the phosphorus content in the resultant nickel deposit. However, at a concentration of between 2.5 and 3 parts per million (33 to 40 micro mol per liter), thiourea causes such bath formulations to cease plating. It has been reported that the critical narrow concentration limits of thiourea in an electroless nickel plating bath to provide satisfactory operation renders this additive agent impractical for commercial plating installations because analysis and replenishment of such baths to maintain proper composition parameters is difficult, time consuming and cost intensive.

Alternative sulfur-containing organic additive agents have been proposed for stabilizing and/or increasing the deposition rate of nickel from electroless nickel plating baths such as described in U.S. Pat. Nos. 2,762,723 and 3,489,576. Such alternative additive materials have also been found commercially impractical because of a very narrow useful concentration range and moreover, many of such sulfur-containing organic compounds do not produce a nickel-phosphorus alloy deposit in which the phosphorus content is below about 8 percent by weight.

Prior art compositions and processes for producing nickel-phosphorus alloy deposits of relatively high phosphorus contents have also been subject to the disadvantages of requiring relatively rigid control of the concentration of the bath constituents detracting from the ease of control, maintenance and replenishment of such baths to maintain optimum operating performance. The use of stabilizing agents for providing increased bath stability has occasioned in prior art compositions a condition of over stabilization whereby a cessation of plating occurs. In such instances, it has been necessary to discard the bath and prepare a new operating bath which constitutes a costly and time-consuming operation.

The present invention provides for an improved electroless nickel plating bath and process for depositing a nickel-phosphorus alloy of relatively low phosphorus content incorporating an additive agent which can satisfactorily be employed over a relatively broad operating concentration range while at the same time increasing the rate of deposition of the nickel by as much as 30 percent or more. The present invention further provides for an improved electroless nickel plating bath and process suitable for use in depositing nickel-phosphorus platings of relatively high phosphorus content providing for greater latitude in variations in the bath constituents thereby achieving simpler control and facilitating maintenance and replenishment of the bath. The present invention further contemplates a method for rejuvenating or restoring an electroless nickel plating bath which has been rendered inoperative due to over stabilization thereof by inclusion of organic and/or inorganic stabilizing agents in excessive amounts by the addition of an additive agent of the present invention whereby satisfactory operation of the bath is restored.

SUMMARY OF THE INVENTION

The benefits and advantages of the present invention are achieved in accordance with the composition aspects thereof by an aqueous electroless nickel plating bath containing nickel ions, hypophosphite ions, and an amount of a sulfonium betaine compound sufficient to control the rate of nickel deposition and the concentration of phosphorus in the nickel deposit. The sulfonium betaine compound corresponds to the structural formula:

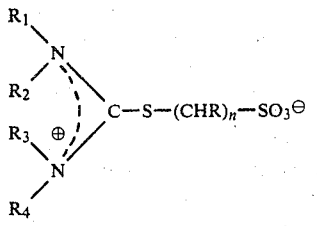

Wherein:

$R_1$, $R_2$, $R_3$ and $R_4$ are the same or different and are H, $C_1$–$C_6$ alkyl radicals, $C_1$–$C_6$ hydroxy alkyl radicals, R is the same or different and is H or OH, and n is an integer of from 1 to 5, as well as mixtures thereof.

The concentration of nickel ions generally ranges from about 1 to about 15 grams per liter (g/l), the hypophosphite ions range from about 2 to about 40 g/l and the sulfonium betaine compound can range from about 1 up to about 200 micro mol per liter. The bath in order to provide satisfactory prolonged commercial operation further incorporates a complexing agent usually present in an amount up to about 200 g/l for complexing the nickel ions present as well as to solubilize the hypophosphite degradation products formed during prolonged usage of the bath. The electroless bath desirably further contains a buffering agent generally present in amounts up to about 30 g/l, a wetting agent to minimize surface pitting, usually present in an amount up to about 1 g/l and hydrogen or hydroxyl ions to provide a bath on the acid or alkaline side as may be desired. Optionally, but preferably, the bath further employs in combination with the sulfonium betaine compound at least one supplemental organic or inorganic stabilizer agent of the various types heretofore known which can be employed in amounts up to that level at which the rate of deposition of nickel is undesirably impaired.

In accordance with the process aspects of the present invention, a low phosphorus-nickel alloy is deposited on a metallic or non-metallic substrate by contacting the cleaned and suitably prepared substrate with the electroless nickel bath at a temperature generally ranging from about 40° C. up to boiling for a period of as little as 1 minute up to several hours or even days to provide a nickel-phosphorus alloy deposit of the desired thickness. During the deposition process, agitation of the bath is preferred, employing mild air or other forms of mechanical agitation. The bath is also preferably subjected to periodic or continuous filtration to remove solid contaminants. The bath is periodically and/or continuously replenished for maintaining the bath constituents within the desirable operating concentrations and at the appropriate pH level.

The present invention further contemplates a process for effecting rejuvenation of an electroless nickel bath which has been rendered inoperative due to an over stabilization thereof by organic and/or inorganic stabilizing agents by the addition of a controlled effective amount of a sulfonium betaine compound to restore operation thereof.

Additional benefits and advantages of the present invention will become apparent upon a reading of the Description of the Preferred Embodiments taken in conjunction with the accompanying examples.

DESCRIPTION OF THE PREFERRED EMBODIMENTS

The aqueous electroless nickel plating baths of the present invention can be operated over a broad pH range including the acid side and the alkaline side at a pH of from about 4 up to about 10. For an acidic bath, the pH can generally range from about 4 up to about 7 with a pH of about 4.3 to about 5.2 being preferred. For an alkaline bath, the pH can range from about 7 up to about 10 with a pH range of from about 8 to about 9 being preferred. Since the bath has a tendency to become more acidic during its operation due to the formation of hydrogen ions, the pH is periodically or continuously adjusted by adding bath soluble and compatible alkaline substances such as alkali metal and ammonium hydroxides, carbonates and bicarbonates. Stability of the operating pH is also provided by the addition of various buffer compounds such as acetic acid, propionic acid, boric acid or the like in amounts up to about 30 g/l with amounts of about 4 to about 12 g/l being typical.

The nickel ions are introduced into the bath employing various bath soluble and compatible nickel salts such as nickel sulfate hexahydrate, nickel chloride, nickel acetate, and the like to provide an operating nickel ion concentration ranging from about 1 up to about 15 g/l with concentrations of from about 3 to about 9 g/l being preferred and with a concentration of about 5 to about 8 g/l being optimum. The hypophosphite reducing ions are introduced by hypophosphorous acid, sodium or potassium hypophosphite, as well as other bath soluble and compatible salts thereof to provide a hypophosphite ion concentration of about 2 up to about 40 g/l, preferably about 12 to 25 g/l with a concentration of about 15 to about 20 g/l being optimum. The specific concentration of the nickel ions and hypophosphite ions employed will vary within the aforementioned ranges depending upon the relative concentration of these two constituents in the bath, the particular operating conditions of the bath and the types and concentrations of other bath components present.

In order to provide a commercially satisfactory plating bath of reasonable longevity and operating performance, it is conventional preferred practice to incorporate a complexing agent or mixture of complexing agents in amounts sufficient to complex the nickel ions present in the bath and to further solubilize the hypophosphite degradation products formed during usage of the bath. The complexing of the nickel ions present in the bath retards the formation of nickel orthophosphite which is of relatively low solubility and tends to form insoluble suspensoids which not only act as catalytic nuclei promoting bath decomposition but also result in the formation of coarse or rough undesirable nickel deposits. Generally, the complexing agents are employed in amounts up to about 200 g/l with amounts of about 15 to about 75 g/l being preferred while amounts of about 20 to about 40 g/l are typical. Complexing or chelating agents of the various types described in the aforementioned U.S. patents, the teachings of which are incorporated herein by reference, can be satisfactorily employed for this purpose and the particular selection of such complexing agent or mixture of complexing agents will be dependent to some extent on the operating bath pH to provide complexors of maximum stability under such specific pH conditions. Typical of such complexing agents are the acid as well as alkali metal and ammonium salts of glycolic acid, lactic acid, malic acid, glycine, citric acid, acetic acid, tartaric acid, succinic acid, and the like. While alkaline earth metal salts can also be employed to some extent, the tendency of such alkaline earth metals to form insoluble precipitates with the bath constituents renders them less desirable and for this reason are preferably excluded. It will also be appreciated, that certain complexing agents such as acetic acid, for example, also act as a buffering agent and the appropriate concentration of such additive components can be optimized for any bath composition in consideration of their dual-functioning properties.

In addition to the foregoing constituents, the bath further includes as an essential constituent, a plating rate and phosphorus controlling agent present in an amount effective to enhance the rate of deposition of the nickel-phosphorus alloy and to provide an alloy deposit generally containing less than about 8 percent by weight phosphorus. The additive agent comprises a sulfonium betaine compound corresponding to the structural formula:

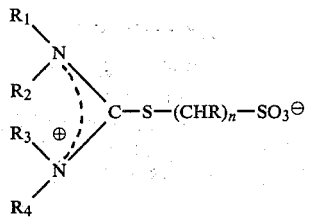

Wherein:

$R_1$, $R_2$, $R_3$ and $R_4$ are the same or different and are H, $C_1$–$C_6$ alkyl radicals, $C_1$–$C_6$ hydroxy alkyl radicals, R is the same or different and is H or OH, and n is an integer of from 1 to 5, as well as mixtures thereof.

A sulfonium betaine compound corresponding to the foregoing structural formula which has been found particularly satisfactory comprises 3-S-isothiuronium propane sulfonate. This compound corresponds to the foregoing structural formula in which $R_1$, $R_2$, $R_3$ and $R_4$ are hydrogen and n is 3. Alternative satisfactory sulfonium betaine compounds which can be employed include N,N'-dimethyl-3-S-isothiuronium propane sulfonate, N,N'-diethyl-3-S-isothiuronium propane sulfonate, N,N'-dihydroxymethyl-3-S-isothiuronium propane sulfonate, N,N'-diisopropyl-3-S-isothiuronium propane sulfonate, N,N,N',N'-tetramethyl-3-S-isothiuronium propane sulfonate, N,N,N'-trimethyl-3-S-isothiuronium propane sulfonate, 2-S-isothiuronium ethane sulfonate, 3-S-isothiuronium propane-2-ol sulfonate and the like. These additive compounds are extremely effective even in relatively low concentrations such as about 1 micro mol per liter to concentrations as high as about 200 micro mol per liter. The foregoing broad range of operating concentrations provides for a substantial simplification of analysis and control of the operating bath under commercial operating conditions providing significant advantages over prior art additive compounds of the types heretofore known. The sulfonium betaine compound in accordance with a preferred practice is employed in acidic baths at a concentration of about 10 to about 150 micro mol per liter with a concentration of about 20 to about 120 micro mol per liter being typical. In alkaline baths, the sulfonium betaine compound is preferably employed at a concentration of about 1 to about 50 micro mol per liter with a concentration of about 2 to about 25 micro mol per liter being typical.

In accordance with a further preferred practice of the present invention, the sulfonium betaine compound is employed in combination with other conventional inorganic and/or organic stabilizing agents of the types heretofore known including lead ions, cadmium ions, tin ions, bismuth ions, antimony ions and zinc ions which can conveniently be introduced in the form of bath soluble and compatible salts including halides, acetates, sulfates, and the like. Alternatively, other stabilizing agents can be employed including cyanide ions, thiocyanate ions, and the like which typically can be used in amounts of from about 1 up to about 20 ppm. Lead ions can be employed in amounts usually up to about 2 ppm; cadmium ions in an amount up to about 10 ppm; antimony and tin ions can be employed in an amount up to about 100 ppm. The specific concentration of such supplemental stabilizing agent or mixtures of supplemental stabilizing agents is limited by such concentrations at which the rate of nickel deposition is inhibited to an undesirable magnitude rendering the bath commercially impractical.

The bath may additionally employ one or a mixture of suitable wetting agents of any of the various types heretofore known which are soluble and compatible with the other bath constituents. The use of such wetting agents is desirable to prevent pitting of the nickel alloy deposit and can usually be employed in amounts up to about 1 g/l.

In accordance with the process aspects of the present invention, a substrate to be plated is contacted with the bath solution at a temperature of at least about 40° C. up to boiling. Electroless nickel baths of an acidic type are preferably employed at a temperature of from about 70° to about 95° C. with a temperature of about 80° to about 90° C. being optimum. Electroless nickel baths on the alkaline side are generally operated within the broad operating range but at a correspondingly lower temperature than the acid-type bath since pH and bath temperature are interrelated in that the rate of nickel deposition increases as the pH increases but the stability of the bath increases as the pH of the bath decreases while the rate of deposition of nickel increases as the temperature increases but with a corresponding decrease in bath stability.

The duration of contact of the electroless nickel solution with a substrate being plated is a function dependent entirely on the desired thickness of the nickel-phosphorus alloy desired. Typically, the contact time can range from as little as about 1 minute to several hours or even several days. Conventionally, a plating deposit of about 0.2 up to about 1.5 mils is a normal thickness for many commercial applications. When wear resistance is desired, such deposits can be applied at a thickness of about 3 to about 5 mils such as on valves, pipes, dies and the like. Thicknesses of up to about 0.25 inch can also be achieved by a correspondingly longer contact time as may be desired.

During the deposition of the nickel alloy plate, it is preferred to employ mild agitation such as mild air agitation, mechanical agitation, bath circulation by pumping, as well as by barrel plating in which the rotation of the immersed barrel imparts agitation to the bath. It is also preferred to subject the bath to a periodic or continuous filtration treatment to reduce the level of contaminants therein. Replenishment of the constituents in the bath is also performed on a periodic or continuous basis to maintain the concentration, particularly of the nickel ions, hypophosphite ions, and pH level within the desired limits.

The substrate to be plated is subjected to a preliminary surface preparation in accordance with conventional practice to provide a clean and catalytically active surface. In the case of substrates which cannot be directly coated employing the electroless nickel bath because of their non-catalytic nature relative to the chemistry of the bath, the substrates can be preliminarily subjected to an electrolytic plating of nickel or such other metal which is catalytic whereby the substrate surface is receptive or made receptive to chemical deposition of nickel from the electroless bath.

In accordance with a further process aspect of the present invention, electroless nickel plating baths which have been rendered inoperative for depositing a nickel-phosphorus alloy deposit on a substrate due to the use of an excessive amount of inorganic and/or organic stabilizing agents, can be restored to effective operation by the addition thereto of a sulfonium betaine compound as hereinbefore defined as well as mixtures thereof in an amount effective to restore satisfactory operation. The concentration of the sulfonium betaine compound employed for effecting rejuvenation can range within the limits as hereinbefore specified with concentrations of from about 20 to about 120 micro mol per liter being typical for acidic-type baths and with concentrations of about 2 to about 25 micro mol per liter being typical for alkaline-type baths. The sulfonium betaine compound is added to the bath in the presence of agitation to effect a substantially uniform distribution thereof.

In order to further illustrate the present invention, the following examples are provided. It will be understood that the examples are provided for illustrative purposes and are not intended to be limiting of the scope of the present invention as herein described and as set forth in the subjoined claims.

EXAMPLE 1

Three 500 milliliter electroless nickel plating baths were prepared containing 27 g/l of nickel sulfate hexahydrate (equivalent to 6 g/l nickel ions); 24 g/l of sodium hypophosphite monohydrate (equivalent to 14.7 g/l hypophosphite ions); 14 g/l malic acid; 9 g/l acetic acid; and the pH of each bath was adjusted to about 5 using ammonium hydroxide. A separate stabilizing agent of the types heretofore employed was added to each bath in accordance with the tabulation as set forth in Table 1.

TABLE 1

| Stabilizer | Conc., mg/l | Rate of Deposition, mil/hr. | Percent P in Deposit |
|---|---|---|---|
| Lead ions | 0.5 | 0.68 | 9.4 |
| Thiourea | 3.0 | 1.1 | 6.2 |
| Thiodiproprionic Acid | 3.0 | 1.3 | 9.6 |

The lead ion concentration as set forth in Table 1 is equivalent to 2.4 micro mols/l; the concentration of the thiourea stabilizer is equivalent to 39.4 micro mols/l; the concentration of the thiodiproprionic acid stabilizer is equivalent to 16.8 micro mols/l.

The temperature of each sample plating bath was adjusted to about 88° to about 90° C. Cleaned stainless steel panels (39 $cm^2$ area) were immersed in each bath and were preliminarily electroplated for 30 seconds while cathodically charged to initiate chemical deposition on the stainless steel. Thereafter, electroless deposition of the nickel-phosphorus alloy was continued for a total of 60 minutes. The resultant nickel-phosphorus alloy deposits were separated from the stainless steel substrates and the foils were measured for thickness and were analyzed for phosphorus content. The rate of deposition in terms of mils per hour and the percentage phosphorus in the nickel alloy deposit are set forth in Table 1.

The data as set forth in Table 1 clearly demonstrates that both thiourea and thiodiproprionic acid are effective in increasing the rate of deposition of the nickel alloy deposit in comparison to the bath sample in which lead ions are the only stabilizer. However, while both thiourea and thiodiproprionic acid are thio compounds, only the thiourea stabilizer lowers the percentage of phosphorus in the nickel alloy deposit. The phosphorus content in the nickel alloy deposit when employing lead ions or thiodiproprionic acid stabilizers is in excess of 9 percent by weight.

EXAMPLE 2

A series of 500 milliliter electroless nickel plating baths was prepared containing 27 g/l nickel sulfate hexahydrate; 30 g/l sodium hypophosphite monohydrate (equivalent to 18.4 g/l hypophosphite ions); 26 g/l lactic acid; 9 g/l acetic acid; and the pH was adjusted to about 4.9 employing ammonium hydroxide. To each bath sample a controlled amount of a thiourea stabilizing agent or a sulfonium betaine compound comprising 3-S-isothiuronium propane sulfonate was added in accordance with the concentrations as set forth in Table 2. One sample bath was devoid of any stabilizing agent to serve as a control.

TABLE 2

| Stabilizer | Concentration, micromols/l | Rate of Deposition, mil/hr. | Percent P in Deposit |
|---|---|---|---|
| None | — | 0.80 | 9.90 |
| Thiourea | 13.1 | 1.00 | 6.67 |
| Thiourea | 26.3 | 1.25 | 6.76 |
| Thiourea | 39.4 | 1.10 | 6.83 |
| Thiourea | 52.6 | 1.02 | 6.49 |
| Thiourea | 65.7 | 1.03 | 6.46 |
| Thiourea | 78.9 | zero | — |
| 3-S—isothiuronium propane sulfonate | 6.3 | 1.10 | 8.22 |
| propane sulfonate | 31.6 | 1.10 | 7.36 |
| propane sulfonate | 63.2 | 1.23 | 6.36 |
| propane sulfonate | 94.9 | 1.00 | 6.29 |
| propane sulfonate | 110.7 | 1.12 | 5.95 |
| propane sulfonate | 126.5 | 1.02 | 5.42 |
| propane sulfonate | 142.4 | 1.05 | 5.34 |
| propane sulfonate | 158.2 | zero | — |

Cleaned stainless steel test panels were plated in accordance with the procedure described in Example 1 employing a bath operating temperature of about 88° C. to about 90° C. for a period of 60 minutes following an initial 30 second electrolytic deposition on each test panel to initiate deposition. The resulting nickel-phosphorus alloy deposit produced from each bath sample was removed as a foil from the test panel and the foils were measured with a dial micrometer to determine the deposition rate and were also analyzed for the percentage of phosphorus in the deposit. The results are also set forth in Table 2.

As will be apparent from the data set forth in Table 2, both the thiourea stabilizing agent and the sulfonium betaine compound additive provide an increase in the rate of deposition of the nickel-phosphorus deposit in comparison to the same bath devoid of any stabilizing additive agent. However, it will be noted that the useful operating range of the sulfonium betaine compound is more than twice that of the thiourea stabilizing agent providing for substantial simplicity in the maintenance and control of the plating bath during commercial operation. Furthermore, the percentage of phosphorus in the deposit obtained from the baths employing the sulfonium betaine compound in accordance with the practice of the present invention attains a value of more than 17 percent less than that obtained employing the thiourea stabilizing agent.

EXAMPLE 3

A six liter electroless nickel plating bath was prepared containing 27 g/l nickel sulfate hexahydrate; 30 g/l sodium hypophosphite monohydrate; 35 g/l lactic acid; 1.5 g/l succinic acid; 0.5 g/l tartaric acid; 1 mg/l lead ions and 1 mg/l cadmium ions in further combination with 60 to 130 micro mols/l of a sulfonium betaine compound comprising 3-S-isothiuronium propane sulfonate. The bath was adjusted and maintained at a pH of about 4.2 to about 5.2 employing ammonium hydroxide and at a temperature ranging from about 85° to about 95° C. for a prolonged test. The bath was periodically replenished to maintain the nickel and hypophosphite ion concentration substantially constant for more than 8 bath turnovers. A bath "turnover" or bath cycle is defined as a plating duration when all of the original nickel metal content in the bath has been consumed and has been replenished by subsequent additions. Generally, the useful operating life of electroless nickel plating baths in accordance with prior art practice ranges from about 6 to about 10 turnovers before the bath must be discarded.

At various times during the operating life of the bath, test panels were plated in the bath in accordance with the procedure as set forth in Example 1 and the nickel-phosphorus alloy deposits were analyzed for percentage of phosphorus as well as the deposition rate of the nickel alloy deposit. The results obtained are set forth in Table 3.

TABLE 3

| Bath Turnovers | Bath pH | Bath Temp. °C. | Deposition Rate mils/hr. | Percent P in Deposit |
|---|---|---|---|---|
| 6.4 | 4.6 | 95° C. | 0.50 | 3.5 |
| 7.8 | 4.8 | 95° C. | 0.48 | 2.8 |
| 8.1 | 4.2 | 85° C. | 0.22 | 3.2 |

The data as set forth in Table 3 clearly demonstrate the very low percentages of phosphorus in the nickel alloy deposit which are obtainable employing an electroless nickel plating bath prepared in accordance with the present invention employing concentrations and operating conditions typical of those employed commercially. It is anticipated from prior testing that if only lead ions and cadmium ions had been employed as stabilizer agents without the presence of the sulfonium betaine compound, the nickel alloy deposit would have contained in excess of about 9 to 10 percent phosphorus particularly when operating at a pH of about 4.2. In contrast, the use of the sulfonium betaine compound provided nickel alloy deposits which were well under 4 percent by weight phosphorus. It will be further noted, that the bath of Example 3 is simple to control because of the relatively broad effective operating range of concentration permissible by the 3-S-isothiuronium propane sulfonate additive compound.

EXAMPLE 4

A 500 milliliter electroless nickel plating bath was prepared using 27 g/l of nickel sulfate hexahydrate (equivalent to 6 g/l of nickel ions); 30 g/l of sodium hypophosphite monohydrate (equivalent to 18.4 g/l of hypophosphite ions); 31 g/l of lactic acid; 2 g/l of malic acid; 0.6 g/l of citric acid; 0.00237 g/l of cadmium acetate dihydrate (equivalent to 1 mg/l of cadmium ions) and sufficient ammonium hydroxide to produce a bath pH of about 5.0. To the bath was then added 0.176 g/l of antimony potassium tartrate trihydrate; —$Sb_2K_2C_8H_4O_{12}.3H_2O$— (equivalent to 64 mg/l of antimony ions). When this plating bath was heated to 90° C., and a cleaned steel panel (80 $cm^2$ surface area) was immersed in the bath, it was found that a deposit of nickel could not be obtained because the bath was over stabilized with antimony and cadmium ions.

To the foregoing bath, 8 mg/l (40.4 micro mol/l) of 3-S-isothiuronium propane sulfonate was added. When this bath was heated to 90° C. and a steel panel (80 $cm^2$ surface area) was immersed in it, an excellent nickel deposit was obtained. The nickel deposition rate was about 1.3 mil/hr. for a thirty minute deposit. The deposit was analyzed and contained 7.95 percent by weight phosphorus.

This example demonstrates that the sulfonium betaine compounds of the invention can also rejuvenate an otherwise over stabilized electroless nickel plating bath to restore it to satisfactory operation condition.

EXAMPLE 5

Four 500 ml electroless nickel plating baths were prepared using 27 g/l nickel sulfate hexahydrate, 30 g/l sodium hypophosphite, 31 g/l lactic acid, 2 g/l malic acid and sufficient ammonium hydroxide to provide a bath pH of about 5.0. Each bath additionally contained 2 mg/l of lead ions and 3 mg/l of cadmium ions to stabilize the bath and brighten the nickel alloy deposits. The lead and cadmium ions were added as the acetate salts. To these four baths, various concentrations of 3-S-isothiuronium propane sulfonate were added and were thereafter heated to between 85° and 90° C. Stainless steel panels (80 $cm^2$ surface area), previously given a 15 second Watts nickel strike to insure plating on the stainless steel and easy subsequent removal of the deposits for analysis, were then plated for 30 minutes. The plating results are summarized in Table 4.

TABLE 4

| Concentration of 3-S—isothiuronium propane sulfonate (micro mol/liter | Deposition Rate (mil/hr.) | Percent by wt. P in Deposit |
|---|---|---|
| Zero | No deposit | No deposit |
| 20.2 | 1.0 | 7.0 |
| 40.4 | 1.0 | 5.2 |
| 60.6 | 0.9 | 3.8 |

The bath that did not contain the sulfonium betaine compound did not produce an electroless nickel deposit because the bath was over stabilized with lead and cadmium. Additions of the sulfonium betaine overcame the excessive concentration of metallic stabilizers, and satisfactory deposits were obtained with good rates of deposition. This example further demonstrates that increasing the concentration of the sulfonium betaine may decrease the percentage of phosphorus in the deposit so that the desired amount of phosphorus can be obtained by controlling the concentration of sulfonium betaine in the plating bath.

EXAMPLE 6

Five 500 ml electroless nickel plating baths were prepared using the bath formulation as listed in Example 5. In place of the lead, however, 16 mg/l of antimony (added as antimony potassium tartrate) were employed as a metallic stabilizer while the cadmium ion (added as the acetate salt) concentration was 1 mg/l. Four of the baths additionally contained various concentrations of 3-S-isothiuronium propane sulfonate. Nickel-phosphorus alloy deposits were obtained using the procedure outlined in Example 5 so that deposition rate and phosphorus content could be measured. Table 5 summarizes the results of these tests.

TABLE 5

| Concentration of 3-S—isothiuronium propane sulfonate (micro mol/liter) | Deposition Rate (mil/hr.) | Percent by wt. P in Deposit |
|---|---|---|
| Zero | 1.0 | 10.6 |
| 20.2 | 1.0 | 7.16 |
| 40.4 | 1.0 | 6.69 |
| 60.6 | 1.0 | 6.82 |
| 80.8 | No deposit | No deposit |

The above data demonstrates that when 3-S-isothiuronium propane sulfonate is used in combination with antimony rather than lead as the metallic stabilizer, the phosphorus content of the resulting electroless nickel deposits does not continue to decrease with increasing concentrations of the sulfonium betaine, but rather remains fairly constant at about 7 percent. This feature is advantageous in commercial practice as wide variations in sulfonium betaine concentration do not result in appreciable changes in the phosphorus content of the nickel-alloy deposit. Excessive amounts of the sulfonium betaine compound can over stabilize the bath and should normally be avoided. The actual concentration that prevents nickel deposition varies, depending on the basic bath composition as well as the concentration and kinds of other metal ions present in the bath.

EXAMPLE 7

An aqueous acidic electroless nickel plating bath is prepared containing the following constituents:

| Constituent | g/l |
|---|---|
| $NiSO_4.6H_2O$ | 27 |
| $NaH_2PO_2.H_2O$ | 30 |
| Malic acid | 15 |
| Lactic acid | 10 |
| Citric acid | 0.5 |
| $Sb^{+++}$ | 0.010 |
| $Pb^{++}$ | 0.0005 |
| $Cd^{++}$ | 0.001 |
| 3-S—isothiuronium propane sulfonate | 0.005 |
| $NH_4OH$ - to give pH 4.6-5.2 | |

The bath is operated at a temperature of about 75° to about 95° C.

The concentrations of the various bath components may be varied up or down by at least 25 percent without seriously impairing the efficacy of the system. Likewise, simple substitutions can be made. For example, sodium hydroxide may be used in place of ammonium hydroxide if an ammonia free bath is desired because of environmental considerations. Potassium hypophosphite may be used in place of sodium hypophosphite. Sodium, potassium, ammonium and similar salts of the complexor acids may be used rather than the parent acids. Likewise, the metallic stabilizers may be added as the salt of any bath compatible anion, such as acetate, tartrate, propionate, etc.

EXAMPLE 8

A 500 ml alkaline electroless nickel bath was prepared containing 26 g/l nickel chloride hexahydrate (equivalent to 6.4 g/l of nickel ions), 15 g/l of sodium hypophosphite (equivalent to 9.2 g/l of hypophosphite ions), 50 g/l of ammonium chloride, 60 g/l of diammonium hydrogen citrate, and 0.003 g/l of 3-S-isothiuronium propane sulfonate (equivalent to 15 micro mol/l). The pH was adjusted to 8.5 and the bath was operated at a temperature of 80° to 85° C.

A test panel comprising a nonconductive polymeric material was subjected to a conventional pretreatment to render the polymeric substrate receptive to a subsequent electroless nickel plating. Such pretreatment as well known in the art includes cleaning, etching, neutralization, and subsequent activation employing an aqueous acidic solution containing a tin-palladium complex to form active sites on the substrate generally followed by an accelerating treatment. The resultant pretreated polymeric test panel was immersed in the alkaline bath for a period of 30 minutes. An inspection of the plated test panel revealed a nickel alloy deposit containing about 3 percent by weight phosphorus. The rate of deposition was about 0.2 mil per hour. While this deposition rate is comparatively low compared to most acidic electroless nickel plating baths, it is generally adequate for many applications such as plating on plastics, glass and other nonmetallic substrates.

It was also observed that further additions of the sulfonium betaine compound to the alkaline bath caused a cessation in the deposition of the nickel alloy deposit when the concentration attained about 25 micro mol per liter. The maximum permissible concentration of the sulfonium betaine compound in such alkaline electroless nickel baths will vary depending upon the specific chemistry of the bath and the types and concentrations of other constituents present. Generally, the useful operating concentration range of the sulfonium betaine compound is lower for alkaline electroless nickel plating baths than for acidic electroless nickel plating baths.

EXAMPLE 9

A series of electroless nickel plating baths is prepared containing nickel ions in a concentration ranging from about 1 up to about 15 g/l; hypophosphite ions in a concentration ranging from about 2 up to about 40 g/l; complexing agents present in amounts up to about 200 g/l including glycolic acid, lactic acid, malic acid, glycine, citric acid, acetic acid, tartaric acid, succinic acid as well as the bath soluble and compatible salts and mixtures thereof; a bath soluble and compatible wetting agent in amounts up to about 1 g/l; stabilizing metal ions including lead, cadmium, tin, bismuth, antimony, zinc and mixtures thereof in concentrations up to about 100 ppm; other stabilizing agents including cyanide, thiocyanate and similar well known stabilizing ions in amounts up to about 20 ppm; and one or a mixture of sulfonium betaine compounds including 3-S-isothiuronium propane sulfonate, N,N'-dimethyl-3-S-isothiuronium propane sulfonate, N,N'-diethyl-3-S-isothiuronium propane sulfonate, N,N'-dihydroxymethyl-3-S-isothiuronium propane sulfonate, N,N'-diisopropyl-3-S-isothiuronium propane sulfonate, N,N,N',N'-tetramethyl-3-S-isothiuronium propane sulfonate, N,N,N'-trimethyl-3-S-isothiuronium propane sulfonate, 2-S-isothiuronium ethane sulfonate, 3-S-isothiuronium propane-2-ol sulfonate as well as mixtures thereof in concentrations ranging from about 1 to about 200 micro mol per liter and hydrogen or hydroxyl ions to provide a bath pH ranging from about 4 to about 7 on the acid side and from about 7 to about 10 on the alkaline side. The specific constituents were varied within the foregoing ranges to provide for optimum deposition of the nickel-phosphorus alloy in accordance with the intended deposit desired.

Test panels were plated in the series of baths maintained at temperatures ranging from about 40° up to boiling for time periods as short as about 1 minute to times of several days to achieve the desired deposit thickness. Many of the baths were operated employing mild agitation.

Satisfactory nickel alloy deposits were obtained.

While it will be apparent that the preferred embodiments of the invention disclosed are well calculated to fulfill the objects above stated, it will be appreciated that the invention is susceptible to modification, variation and change without departing from the proper scope or fair meaning of the subjoined claims.

What is claimed is:

1. An aqueous electroless nickel plating bath comprising nickel ions and hypophosphite ions in an amount sufficient to chemically deposit nickel and an amount of a sulfonium betaine compound sufficient to control the rate of nickel deposition and the concentration of phosphorus in the nickel deposit, said sulfonium betaine compound corresponding to the structural formula:

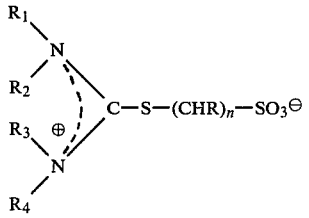

Wherein:

$R_1$, $R_2$, $R_3$ and $R_4$ are the same or different and are H, $C_1$–$C_6$ alkyl radicals, $C_1$–$C_6$ hydroxy alkyl radicals, R is the same or different and is H or OH, and n is an integer of from 1 to 5, as well as mixtures thereof.

2. The bath as defined in claim 1 further including a complexing agent present in an amount sufficient to complex said nickel ions present and to solubilize any hypophosphite degradation products present in said bath.

3. The bath as defined in claim 1 having a pH of about 4 to about 10.

4. The bath as defined in claim 1 further including a buffering agent.

5. The bath as defined in claim 1 in which said sulfonium betaine compound is present in an amount of at least about 1 up to about 200 micro mol/l.

6. The bath as defined in claim 1 having a pH of about 4 to about 7 and in which said sulfonium betaine compound is present in an amount of about 20 to about 120 micro mol/l.

7. The bath as defined in claim 1 having a pH of about 7 to about 10 and in which said sulfonium betaine compound is present in an amount of about 2 to about 25 micro mol/l.

8. The bath as defined in claim 1 in which said nickel ions are present in an amount of about 1 to about 15 g/l.

9. The bath as defined in claim 1 in which said hypophosphite ions are present in an amount of about 2 to about 40 g/l.

10. The bath as defined in claim 1 in which said nickel ions are present in an amount of about 1 to about 15 g/l, said hypophosphite ions are present in an amount of about 2 to about 40 g/l, and said sulfonium betaine compound is present in an amount of at least about 1 up to about 200 micro mol/l.

11. The bath as defined in claim 10 further containing a complexing agent present in an amount up to about 200 g/l.

12. The bath as defined in claim 11 further containing a complexing agent present in an amount of about 20 to about 40 g/l.

13. The bath as defined in claim 10 further containing a buffering agent present in an amount up to about 30 g/l.

14. The bath as defined in claim 1 in which said sulfonium betaine compound comprises 3-S-isothiuronium propane sulfonate.

15. The bath as defined in claim 1 in which said sulfonium betaine compound is selected from the group consisting of N,N'-dimethyl-3-S-isothiuronium propane sulfonate, N,N'-diethyl-3-S-isothiuronium propane sulfonate, N,N'-dihydroxymethyl-3-S-isothiuronium propane sulfonate, N,N'-diisopropyl-3-S-isothiuronium propane sulfonate, N,N,N',N'-tetramethyl-3-S-isothiuronium propane sulfonate, N,N,N'-trimethyl-3-S-isothiuronium propane sulfonate, 2-S-isothiuronium ethane sulfonate, 3-S-isothiuronium propane-2-ol sulfonate and mixtures thereof.

16. The bath as defined in claim 1 further containing a supplemental stabilizer agent selected from the group consisting of lead ions, cadmium ions, tin ions, bismuth ions, antimony ions, zinc ions, cyanide ions, thiocyanate ions, and mixtures thereof present in combination with said sulfonium betaine compound in an amount below that at which the rate of nickel deposition is reduced to an undesirable magnitude.

17. The bath as defined in claim 1 in which said nickel ions are present in an amount of about 1 to about 15 g/l, said hypophosphite ions are present in an amount of about 2 to about 40 g/l, said sulfonium betaine compound is present in an amount of at least about 1 up to about 200 micro mol/l, said bath further including a complexing agent present in an amount up to about 200 g/l, a buffering agent present in an amount up to about 30 g/l and a wetting agent present in an amount up to about 1 g/l.

18. A process for chemically depositing nickel on a substrate which comprises the steps of contacting a substrate to be plated with an electroless nickel bath as defined in claim 1 for a period of time sufficient to deposit nickel on the substrate to the desired thickness.

19. The process as defined in claim 18 in which said electroless nickel bath further contains a supplemental stabilizer agent selected from the group consisting of lead ions, cadmium ions, tin ions, bismuth ions, antimony ions, zinc ions, cyanide ions, thiocyanate ions, and mixtures thereof present in combination with said sulfonium betaine compound in an amount below that at which the rate of nickel deposition is reduced to an undesireable magnitude.

20. A process for rejuvenating an aqueous electroless nickel bath which has been rendered inoperative due to the presence of an excessive concentration of supplemental stabilizing agents therein which comprises the steps of adding to said bath a sulfonium betaine compound corresponding to the structural formula:

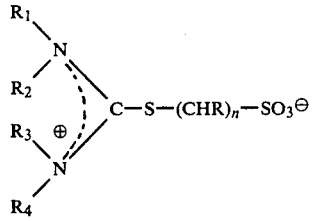

wherein:

$R_1$, $R_2$, $R_3$ and $R_4$ are the same or different and are H, $C_1$–$C_6$ alkyl radicals, $C_1$–$C_6$ hydroxy alkyl radicals, R is the same or different and is H or OH, and n is an integer of from 1 to 5, as well as mixtures thereof; in an amount sufficient to rejuvenate and restore the plating activity of said bath.

* * * * *